US012029263B2

(12) United States Patent
Temeng

(10) Patent No.: US 12,029,263 B2
(45) Date of Patent: Jul. 9, 2024

(54) PUMP-CONDITIONED GARMENT AND APPARATUS THEREFOR

(71) Applicant: Kwaku Temeng, Wilmington, DE (US)

(72) Inventor: Kwaku Temeng, Wilmington, DE (US)

( * ) Notice: Subject to any disclaimer, the term of this patent is extended or adjusted under 35 U.S.C. 154(b) by 113 days.

(21) Appl. No.: 17/868,891

(22) Filed: Jul. 20, 2022

(65) Prior Publication Data

US 2022/0346470 A1 Nov. 3, 2022

Related U.S. Application Data

(63) Continuation-in-part of application No. 16/502,854, filed on Jul. 3, 2019, now Pat. No. 11,432,597.

(51) Int. Cl.
*A41D 13/002* (2006.01)

(52) U.S. Cl.
CPC ..... *A41D 13/0025* (2013.01)

(58) Field of Classification Search
CPC ..... A41D 13/0158; A41D 13/0053; A41D 13/005
See application file for complete search history.

(56) References Cited

U.S. PATENT DOCUMENTS 3,049,896 A * 8/1962 Webb ..... A62B 17/001 62/331
5,201,365 A * 4/1993 Siegel ..... A41D 13/0056 607/104
5,263,336 A * 11/1993 Kuramarohit ..... F25D 7/00 62/316
5,415,222 A * 5/1995 Colvin ..... F28D 20/02 165/902
5,735,145 A * 4/1998 Pernick ..... A61F 13/53 66/196
5,970,519 A * 10/1999 Weber ..... A41D 13/0025 2/81
6,085,353 A 7/2000 van der Sleesen
6,105,382 A * 8/2000 Reason ..... A41D 13/005 165/46
6,109,338 A * 8/2000 Butzer ..... A41D 13/005 607/104

(Continued)

FOREIGN PATENT DOCUMENTS

CN 215649363 1/2022
CN 215649363 U * 1/2022
WO 2017048198 3/2017

OTHER PUBLICATIONS

Springs Creative Website, Spacer Fabric, https://www.springscreative.com/products/spacerfabric/, downloaded Jun. 26, 2019.

(Continued)

*Primary Examiner* — Jillian K Pierorazio
(74) *Attorney, Agent, or Firm* — Steven H. Meyer, Esq.

(57) ABSTRACT

To pump-condition a garment that covers at least a portion of an individual, at least one fluid-circulating vent panel circulates a fluid adjacent the garment in an effort to condition the individual. A pump provides a motive force to circulate the circulating fluid through each vent panel. A circulation layer within the vent panel defines a plurality of channels therethrough. The channels allow the circulating fluid to pass both laterally through an opening in a peripheral edge of the vent panel and directly through a diffusing layer of the vent panel.

20 Claims, 7 Drawing Sheets

(56) References Cited

U.S. PATENT DOCUMENTS 6,122,785 A * 9/2000 Bondie ..... A45C 13/02 5/709
6,158,504 A * 12/2000 Reznik ..... F25D 31/00 165/104.21
6,257,011 B1 * 7/2001 Siman-Tov ..... A61F 7/10 165/46
6,260,201 B1 * 7/2001 Rankin ..... A41D 13/0053 2/81
6,339,845 B1 1/2002 Burns
6,349,412 B1 * 2/2002 Dean ..... A41D 13/0053 2/102
6,681,399 B1 1/2004 Kerr
7,412,728 B2 8/2008 Alesina
7,823,625 B2 * 11/2010 Gammons ..... F16L 37/0841 165/46
7,827,624 B1 * 11/2010 Cole ..... A41D 13/0053 2/458
8,281,609 B1 * 10/2012 Rothschild ..... A41D 13/0053 62/259.3
8,359,871 B2 * 1/2013 Woods ..... H10N 10/13 62/3.2
8,397,517 B2 * 3/2013 Monk ..... G05D 23/1919 62/3.5
8,397,518 B1 * 3/2013 Vistakula ..... A61F 7/02 62/3.5
8,424,120 B2 * 4/2013 Steingrube ..... A62B 17/005 2/458
9,309,689 B2 4/2016 Fier
9,950,492 B2 * 4/2018 Banowit ..... B32B 3/20
10,195,468 B2 * 2/2019 Allan ..... A62B 17/006
2002/0029410 A1 * 3/2002 Szymocha ..... A41D 13/0051 2/458
2003/0019476 A1 * 1/2003 Chambers ..... A42C 5/04 123/438
2003/0029186 A1 * 2/2003 Schegerin ..... F25D 3/14 62/299
2003/0045918 A1 * 3/2003 Turner ..... A61F 7/02 607/108
2004/0083526 A1 * 5/2004 Ichigaya ..... A41D 13/0025 2/2.14
2005/0139351 A1 * 6/2005 Chambers ..... F28F 21/00 62/259.3
2005/0197684 A1 9/2005 Koch
2006/0026743 A1 2/2006 Farnworth
2006/0191063 A1 * 8/2006 Elkins ..... A62B 17/005 2/458
2007/0000008 A1 * 1/2007 Sawicki ..... A41D 13/0025 2/69
2007/0084496 A1 * 4/2007 Edey ..... H10N 10/00 136/204
2007/0095088 A1 * 5/2007 Drobot Isherwood ..... A41D 31/12 62/259.3
2007/0136922 A1 * 6/2007 Oliver ..... B64D 10/00 2/69
2008/0141428 A1 * 6/2008 Kapah ..... F41H 1/02 2/2.5
2009/0077710 A1 3/2009 Bay
2009/0199571 A1 * 8/2009 Creech ..... A61F 7/02 62/515
2009/0260711 A1 * 10/2009 Alder ..... B63C 9/18 2/458
2009/0308082 A1 * 12/2009 Monk ..... B62J 33/00 62/3.5
2010/0011491 A1 * 1/2010 Goldmann ..... A42B 1/008 2/458
2010/0084125 A1 * 4/2010 Goldstein ..... F17C 11/00 62/3.5
2010/0125928 A1 * 5/2010 Smith ..... B63C 11/08 165/61
2010/0186134 A1 * 7/2010 Hunter ..... B32B 27/12 2/2.5
2010/0223943 A1 * 9/2010 Loukaides ..... A41D 13/0053 62/259.3
2010/0319381 A1 * 12/2010 Hubler ..... A41D 13/0053 62/259.3
2012/0036623 A1 * 2/2012 Minogue ..... A41D 13/0158 2/463
2012/0085105 A1 * 4/2012 Quisenberry ..... F24F 5/0042 62/476
2013/0025315 A1 * 1/2013 Freeman ..... F28F 13/003 165/46
2013/0178146 A1 7/2013 Stockett
2013/0338552 A1 * 12/2013 Malhi ..... A61H 23/04 601/150
2014/0130225 A1 * 5/2014 Balzano ..... F41H 1/02 2/2.5
2014/0201891 A1 * 7/2014 Turner ..... A41D 13/015 2/455
2014/0222121 A1 * 8/2014 Spence ..... A61F 7/02 607/104
2015/0025485 A1 1/2015 Luckemeyer
2015/0374537 A1 * 12/2015 Susi ..... A61F 7/007 607/104
2016/0366963 A1 * 12/2016 Koshkaroff ..... A41D 3/02
2017/0028669 A1 * 2/2017 Regester ..... A41D 3/00
2017/0065005 A1 * 3/2017 Nordstrom ..... A41D 27/10
2017/0095395 A1 * 4/2017 Wennen ..... A61F 5/02
2017/0099899 A1 * 4/2017 Pezzimenti ..... A41D 1/04
2018/0317572 A1 * 11/2018 Guttman ..... A41D 27/28
2018/0338563 A1 * 11/2018 Moretti Polegato ..... A43B 7/06
2019/0045857 A1 * 2/2019 Fan ..... A41D 13/005
2019/0254361 A1 * 8/2019 Gorissen ..... B32B 27/40
2019/0331463 A1 * 10/2019 Strum ..... F41H 5/0471
2020/0000640 A1 * 1/2020 Mondal ..... A61L 15/44
2021/0137181 A1 * 5/2021 Patel ..... A41D 31/145
2022/0029410 A1 1/2022 Fukuhara

OTHER PUBLICATIONS

TTP Ventus Website, Disc Pump Products, https://www.ttpventus.com/products, downloaded Jun. 26, 2019.

* cited by examiner

PUMP-CONDITIONED GARMENT AND APPARATUS THEREFOR

CROSS-REFERENCE TO RELATED APPLICATION

The present application is a continuation-in-part of U.S. patent application Ser. No. 16/502,854, filed on Jul. 3, 2019 and entitled "Pump-Conditioned Garment and Apparatus Therefor", and published as U.S. Pat. App. Pub. No. US 2021/0000195, hereby incorporated by reference in its entirety.

FIELD

The present disclosure relates to a garment with an apparatus included therewith that pumps or otherwise circulates a fluid within the garment. More particularly, the present disclosure relates to such a garment and apparatus with an air pump for circulating venting air within the garment so as to provide a wearer of the garment with a more comfortable environment.

BACKGROUND

To protect an individual against wind, rain, and similar adverse environmental conditions, it is believed to be generally known that an external garment such as a running jacket, a ski jacket, a parka, and the like may be designed with a fabric shell or the like that has low air permeability so as to prevent external air from being admitted, perhaps in combination with an insulating layer. Thus, the fabric shell and the insulating layer if present act to keep adverse environmental conditions such as rain, snow, and cold air away from direct contact with the individual, and also to keep favorable environmental conditions such as warm dry air in closer contact with the individual.

Notably, when such individual wears such external garment during exercising, for example, the fabric shell and insulating layer if present provide good protection during the initial stages of exercising, when the body of the individual is relatively cool and dry. However, as the individual continues to exercise and the body thereof becomes relatively warm and wet, the fabric shell and insulating layer if present can tend to trap heat and moisture within the garment, to the point where the individual can become uncomfortably warm and humid within such garment. As should be appreciated, the fabric shell and insulating layer if present limit the venting of internal moisture and heat generated from such exercise so that the interior of the garment becomes uncomfortably humid and wet and creates a relatively high level of discomfort.

To alleviate such discomfort as caused by air impermeability and/or heat insulation in a garment, it is among other things known that air vents, water vapor vents, and/or the like may be incorporated into the garment so as to provide an exchange of heat and/or moisture between the internal environment of the garment and the external environment. Such vents may generally be characterized by control mechanisms such as zippers or sliders that open to allow for the exchange of air between the interior and exterior of the garment at the discretion of the individual wearing same, mesh panels in the fabric shell that allow for a continuous exchange of air, or the like.

However, such control mechanisms, mesh panels, and the like have been found to have drawbacks and limitations. Firstly, the individual wearing the garment typically may have to stop the exercising activity to make adjustments as necessary, for example to open or close zippers. Secondly, such adjustments may be physically challenging, such as for example if the zippers are on a back side of the garment. In such an instance, it may be that the garment must be removed for gaining access to such zippers. Thirdly, opening and/or opened vents during rain and snow events can lead to interior penetration of water within the garment, which can be uncomfortable and perhaps can lead to hypothermia. Fourthly, even when vents are opened, the full benefits of venting may be unachievable due to varying obstructions. Here, it may be that a vent is blocked internally by an insulating layer, or externally by an external object such as a covering garment, a backpack, or the like. With regard to a backpack in particular, it is known that covering the back of the individual therewith can allow an excessive amount of warmth and perspiration to build up thereat, regardless of whatever venting may be provided in the garment in such region.

In general, garment venting suffers from the difficulty of adjusting a vent to match a current level of exertion and also any change in ambient conditions. That is, current garment vents do not allow for increased venting during a time of exertion and also for decreased venting at a time of rest, without manual adjustment, and also do not allow for increased venting when the external ambient temperature rises and also for decreased venting when such external ambient temperature falls, also without manual adjustment. Likewise, current garment vents do not allow for changes in external humidity, in internal humidity, in daylight, in wind speed, etc. Instead, an individual wearing a vented garment must focus on such issues to the point of distraction, and oftentimes fails to do so with the result being that the individual becomes over-heated, over-perspired, and/or overly chilled, among other things, with resulting discomfort.

Convective air flow systems have been proposed which employ one or more fans to induce air flow into and out of a garment. However, the fans are blade-based and can become compromised if the blades encounter interference. Also, the fans become all but useless if covered by a covering garment, a backpack, etc., and generally the fans are conspicuous and yet not aesthetically pleasing.

Accordingly, a need exists for a pump-conditioned garment and apparatus therefor which can be employed to actively and adaptably vent a garment. Specifically, a need exists for such a garment and apparatus that pumps or otherwise circulates a fluid within the garment in an effort to establish an environment within the garment that is more comfortable to an individual wearing the garment. More particularly, a need exists for such a garment and apparatus with an air pump for circulating venting air within the garment in response to sensed changes to the environment within the garment and also changes to the external environment.

SUMMARY

The aforementioned needs are satisfied by an apparatus that pump-conditions a garment, where the garment covers at least a portion of an individual. In the apparatus, at least one fluid-circulating vent panel circulates a fluid adjacent the garment in an effort to condition the individual. A pump provides a motive force to circulate the circulating fluid through each vent panel. The garment comprises a covering layer, and each vent panel has a multi-layer planar construction including an attaching layer, a diffusing layer, and a circulation layer.

The attaching layer is at one face of the vent panel and faces toward the covering layer. The attaching layer is generally impermeable to the circulating fluid. The vent panel is attached to the covering layer at the attaching layer. The diffusing layer is at an opposing face of the vent panel and faces away from the covering layer. The diffusing layer is generally permeable to the circulating fluid to allow same to circulate therethrough in an effort to condition the individual. The circulation layer is interposed between the attaching layer and the diffusing layer, and defines a plurality of channels therethrough. Each channel of the circulation layer is in communication with the pump by way of a panel manifold at one peripheral edge of the vent panel and is also in communication with an opening defined at another peripheral edge of the vent panel. The channels of the circulation layer allow the circulating fluid to pass therethrough between the panel manifold and the opening and also between the panel manifold and the diffusing layer. The opening imparts a lateral flow of the circulating fluid along the covering layer of the garment, and the diffusing layer imparts a direct flow of the circulating fluid away from the covering layer of the garment.

BRIEF DESCRIPTION OF THE DRAWINGS

The foregoing summary as well as the following detailed description of various embodiments of the present innovation will be better understood when read in conjunction with the appended drawings. For the purpose of illustrating the various embodiments of the innovation, there are shown in the drawings embodiments that may be preferred. As should be understood, however, the innovation is not limited to the precise arrangements and instrumentalities shown. In the drawings.

DETAILED DESCRIPTION OF PREFERRED EMBODIMENTS

Figure 1:
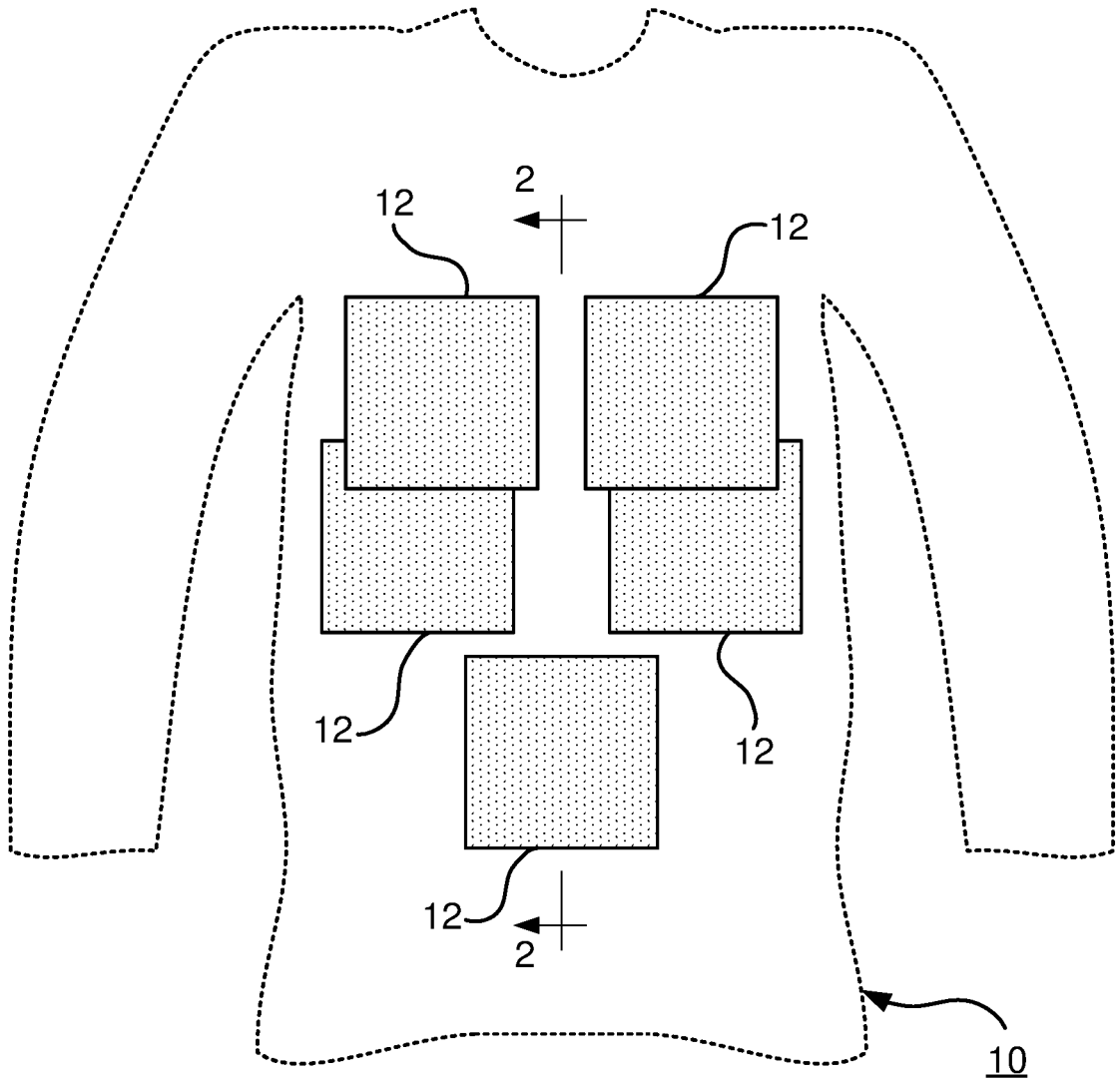
FIG. 1 is a front elevational and somewhat schematic depiction of a garment having one or more vent panels therein for circulating a fluid within the garment in accordance with various embodiments of the present innovation.

Certain terminology may be used in the following description for convenience only and is not limiting. The words "lower" and "upper" and "top" and "bottom" designate directions in the drawings to which reference is made. The terminology includes the words above specifically mentioned, derivatives thereof and words of similar import.

Where a term is provided in the singular, the inventors also contemplate aspects of the invention described by the plural of that term. As used in this specification and in the appended claims, the singular forms "a", "an" and "the" include plural references unless the context clearly dictates otherwise, e.g., "a tip" includes a plurality of tips. Thus, for example, a reference to "a method" includes one or more methods, and/or steps of the type described herein and/or which will become apparent to those persons skilled in the art upon reading this disclosure.

Unless defined otherwise, all technical and scientific terms used herein have the same meaning as commonly understood by one of ordinary skill in the art to which this invention belongs. Although any methods and materials similar or equivalent to those described herein can be used in the practice or testing of the present innovation, the preferred methods, constructs and materials are now described.

Figure 2:
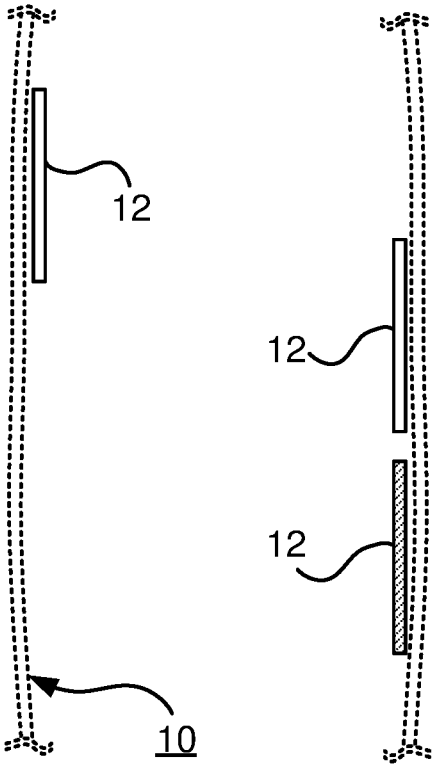
FIG. 2 is a cross-sectional view of the garment of FIG. 1 taken along the line 2-2 thereof, and in particular shows a vent panel on the left side of the front of the garment as seen in FIG. 1, a vent panel on the left side of the back of the garment as seen in FIG. 1, and a portion of a vent panel in the lower center of the back of the garment as seen in FIG. 1, in accordance with various embodiments of the present innovation.

Turning now to FIGS. 1 and 2, a representation of a pump-conditioned garment 10 is shown to include one or more fluid-circulating vent panels 12 in various embodiments of the present innovation. As shown in the representation of FIGS. 1 and 2, the garment 10 includes a pair of vent panels 12 on the left and right side of the interior of the front of the garment 10, another pair of vent panels 12 on the left and right side of the interior of the back of the garment 10, where the back pair are in elevation slightly lower than the front pair, and a single vent panel 12 in the lower center of the interior of the back of the garment, where the center panel 12 is in elevation below the rear pair.

As will be set forth in more detail below, each fluid-circulating vent panel 12 is intended to circulate a fluid such as air or a liquid adjacent the garment 10 in an effort to cool such adjacency and/or remove moisture, among other things. Notably, the garment 10 may be most any garment without departing from the spirit and scope of the present innovation. As shown in FIGS. 1 and 2, the garment 10 is generally shaped to be worn about the torso of an individual (not shown), although it is to be recognized that the garment 10 could also be shaped to be worn as pants about the legs, a hat on a head, sleeves for arms, leggings for legs, gloves for hands, socks or shoes for feet, etc. Likewise, it is to be recognized that the garment 10 could be shaped to be worn around a body or portion thereof of an animal such as a horse, a dog, a pack animal, etc. In fact, the garment 10 need not necessarily be an article of clothing, and instead could be an external item such as a blanket or other covering device. In general, the design of the garment 10 and functional use thereof may be most any design and use, and such design and use are generally known or should be apparent to the relevant public and therefore need not be set forth herein in any detail.

As was alluded to above, the garment 10 may be designed to protect the individual against wind, rain, and similar adverse environmental conditions, and for example may be designed with an exterior fabric shell or the like that has low air permeability so as to prevent external air from being admitted. Additionally, the garment may be designed to include an insulating layer for added thermal warmth. However, such fabric shell and such insulating layer are not a requirement of the present innovation. That said, it may be that based on the presence of such fabric shell and/or insulating layer in the garment 10, or based on the presence of other constructs in the garment 10, the individual wearing the garment 10 may grow to become uncomfortable, perhaps by being overheated during activity, by perspiring during activity, by accumulating humidity during activity, etc. Accordingly, the vent panels 12 are provided in the garment 10 in an effort to alleviate such overheating, perspiration, humidity, and other similar discomforting factors.

As shown in FIGS. 1 and 2, the vent panels 12 are located in regions of the garment 10 that correspond to areas of the body that typically experience heightened discomfort. As may be appreciated, if as is shown the garment 10 is a jacket or the like for being worn about the torso of an individual, the areas of the body for which discomfort may be experienced include the armpits, the chest, and the upper, central, and lower back, and the vent panels 12 may thus be located in corresponding regions of the garment 10. As should be appreciated, such areas of discomfort and corresponding regions in the garment 10 may be most any appropriate areas and corresponding regions without departing from the spirit and scope of the present innovation. Such regions and areas are generally known or should be apparent to the relevant public, and therefore need not be set forth in detail in the present disclosure other than that which is provided.

Each vent panel 12 may be attached to the garment 10 in any appropriate manner without departing from the spirit and scope of the present innovation. Depending on circumstances, it may be advisable to sew the vent panel 12 directly to the garment or to otherwise permanently attach same, perhaps by way of a gluing or welding operation or the like. Alternately, it may be advisable to removably attach the vent panel, perhaps by way of a zippering arrangement, a hook-and-loop fastening arrangement, or the like. Attaching the vent panel 12 to the garment 10 is known or should be apparent to the relevant public and therefore need not be set forth herein in any detail other than that which is provided.

Generally, the garment 10 may be expected to have a primary interior surface and a primary exterior surface, among other things, where it is to be understood that the primary interior surface is that surface that faces toward and is closest to the body of the individual wearing the garment 10, and the primary exterior surface is that surface that faces away from and is farthest from the body of the individual wearing the garment 10. Empirically, it has been found that when the garment 10 is an over-garment such as a jacket or the like that is intended to be worn over another garment, each vent panel 12 works better when attached to the primary interior surface of such over-garment 10, as is the case in FIGS. 1 and 2.

Likewise, it has been found that when the garment 10 is an under-garment such as a shirt or the like that is intended to be worn next to the skin of the individual, each vent panel 12 works better when attached to the primary exterior surface of such under-garment 10. In particular, it has been found that by positioning each vent panel 12 away from the skin of the individual, the vent panel 12 is better able to circulate fluid about the individual and adjacent the vent panel 12 of the garment 10. Also, in the case where the garment 10 is an under-garment and is worn under another garment, attaching each vent panel 12 to the primary exterior surface of such garment 10 is more-or-less a functional equivalent to the case where the garment 10 is an over-garment worn over another garment and each vent panel 12 thereof is attached to the primary interior surface thereof, in that in both cases fluid is caused to flow between two layers of garment. Note though that if the garment 10 is a single layer worn by an individual without any other over- or under-garment, as may be the case during warm weather, the vent panel 12 should be attached to the primary interior surface of such garment 10 even though adjacent the skin of the individual. As will be set forth in more detail herein, the fluid circulated by each vent panel 12 is expected to be air, although other fluids may also be circulated without departing from the spirit and scope of the present innovation.

Figure 3:
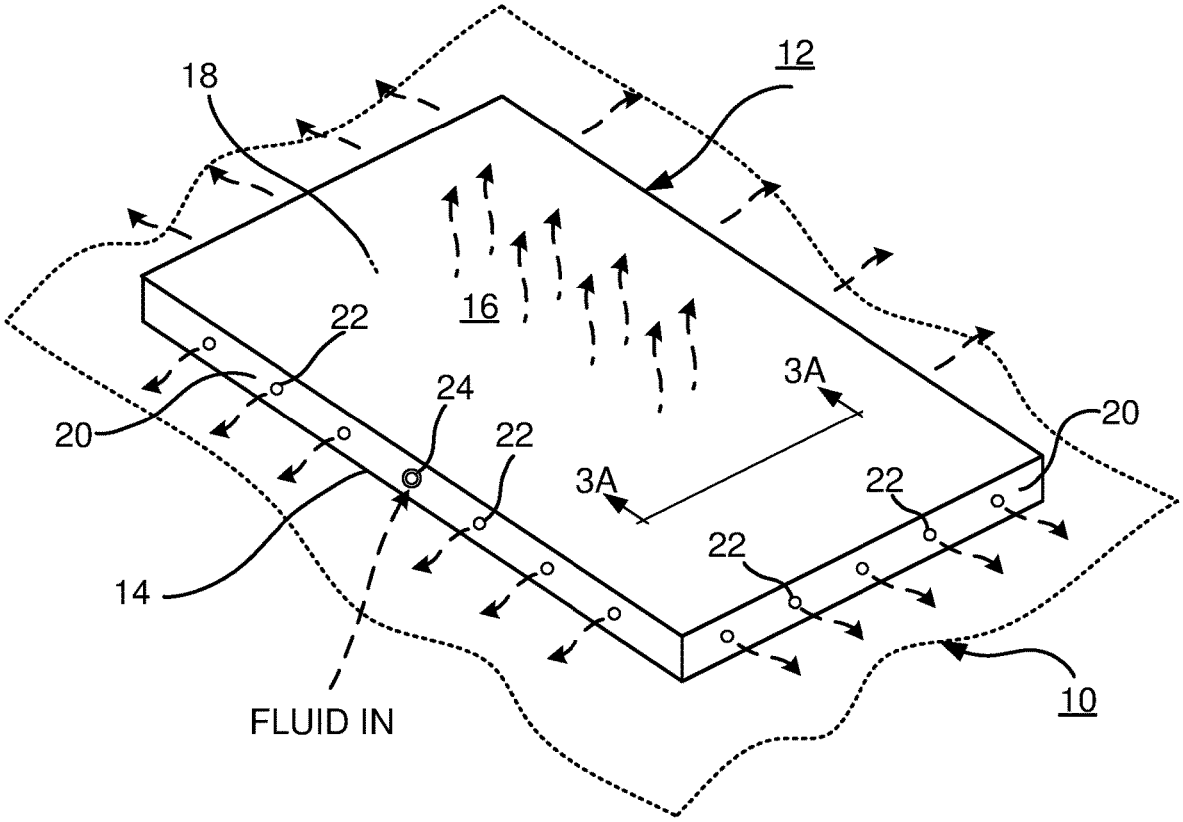
FIG. 3 is a partially cut-away perspective view of a vent panel from FIG. 1 and shows positive pressure flow therethrough in accordance with various embodiments of the present innovation.
Figure 3A:
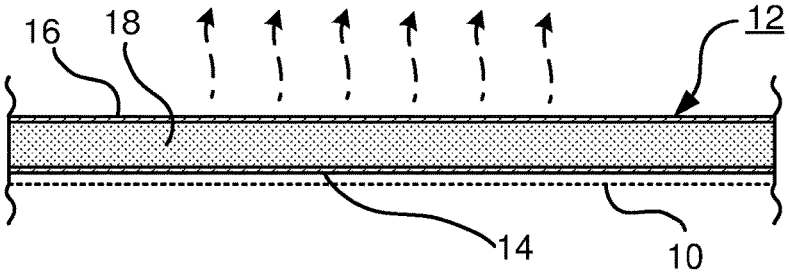
FIG. 3A is a cross-sectional view of the vent panel of FIG. 3 taken along the line 3A-3A thereof, and in particular shows the layers of the vent panel in relation to the garment in accordance with various embodiments of the present innovation.

Turning now to FIGS. 3 and 3A, it is seen that each vent panel 12 is generally of a multi-layer planar construction, with an impermeable attaching layer 14 at one face of the vent panel 12 which is intended to face toward the garment 10, a permeable diffusing layer 16 at the opposing face of the vent panel 12 which is intended to face away from the garment 10, and a circulation layer 18 interposed therebetween. Presumptively, the vent panel 12 and the layers 14, 16, and 18 thereof are generally flexible, at least enough so that the vent panel 12 is permitted to flex along with the garment 10 as attached thereto. Thus, the vent panel 12 does not impede the movement of the garment 10, such as may be advantageous if the garment is to be worn during exercise. The attaching layer 14 may for example be constructed from a plastic or elastomeric material or a lightweight woven fabric which is generally impermeable to the circulating fluid, be it air or otherwise, and correspondingly the diffusing layer 16 may for example be constructed from a plastic or elastomeric material or a knit/woven fabric with stretch which is indeed generally permeable to such circulating fluid, again be it air or otherwise.

As interposed between the attaching layer 14 and the diffusing layer 16, the circulation layer 18 may be constructed from a material that allows the circulating fluid, be it air or otherwise, to pass therethrough without undue constraint, and allow same to in fact circulate about the individual and adjacent the vent panel 12 within the garment 10. As an example, such circulation layer 18 may be constructed from a quilted microfilament yarn or the like, such that the circulation layer 18 is highly permeable to the circulating fluid, be it air or otherwise. One example of a product having such attaching layer 14, diffusing layer 16, and circulation layer 18 is Spacer Fabric as marketed by Springs Creative Products Group, LLC. of Rock Hill, South Carolina (https://www.springscreative.com/products/spacerfabric/), or as marketed by Highland Industries of Greensboro, North Carolina (https://www.highlandindustries.com/products/hiflow-spacer-fabrics/), although it should be appreciated that other products may alternately be employed without departing from the spirit and scope of the present innovation.

As seen in FIG. 3 in particular, the vent panel 12 with the layers 14, 16, 18 may also be provided with a peripheral edge band 20 or the like in an effort to manage the circulation of fluid, be it air or otherwise, through the vent panel 12. As shown, the peripheral edge band 20 essentially wraps around the periphery of the vent panel 12 in an effort to at least somewhat seal the edges of the vent panel 12 and thus restrict the circulation of fluid, be it air or otherwise. Accordingly, such circulating fluid is directed to flow more through the circulation layer 18 of the vent panel 12. As should be appreciated, then, the edge band 20 may for example be constructed from a plastic or elastomeric material which is generally impermeable to the circulating fluid, be it air or otherwise. Likewise, such generally impermeable edge band 20 may for example be imparted to the vent panel by fusing the material of the vent panel 12 at the edges thereof, perhaps by way of a heat source or by way of sonic welding or the like.

That said, such edge band 20 may be made to be at least partially permeable, by selecting an appropriate material, or by being manufactured to include venting pores 22 or the like, where the vent pores 22 have appropriate diameters and appropriate spacing. Such diameters may for example be on the order of 2-3 mm and such spacing maybe on the order of every 10-20 mm along the edge band 20. Judging an appropriate amount of permeability for the edge band 20 and manufacturing and/or introducing same into such edge band 20 is known or should be apparent to the relevant public and therefore need not be set forth herein in any detail beyond that which is provided. Accordingly, the edge band 20 may have any appropriate permeability and may be designed and manufactured in any appropriate manner without departing from the spirit and scope of the present innovation.

As may now be appreciated, each vent panel 12 within the garment 10 allows the circulation of fluid, be it air or otherwise, in one of at least two manners. In the first manner, and as shown in FIGS. 3 and 3A, positive pressure is introduced externally to the vent panel 12 in an effort to drive the circulating fluid (the directional arrows of FIG. 3) into the vent panel 12 by way of a port 24 thereof. As seen, the port 24 is located on or about the edge band 20 of the vent panel 12 and is in direct communication with the circulation layer 18 of the vent panel 12, although such port 24 may be located elsewhere if necessary and/or appropriate without departing from the spirit and scope of the present innovation. That said, locating the port 24 on or about the edge band 20 is believed to be advantageous in that the overall vent panel 12 may be generally flatter and accordingly less conspicuous. At any rate, upon being introduced into the vent panel 12 by way of the port 24, the circulating fluid then passes through the circulation layer 18 of the vent panel 12 and escapes therefrom and into the adjacent areas by way of the diffusing layer 16 of the vent panel and any venting pores 22 in the edge band 20 of the vent panel 12. Presumptively, such circulating fluid as supplied by the positive pressure is of a cooler and/or dryer nature than the environment within the garment 10, and thus provides a degree of comfort to the individual wearing same.

As might now be appreciated, in the second manner, which is in opposition to the manner shown in FIGS. 3 and 3A, negative pressure is introduced externally to the vent panel 12 in an effort to draw or pull the circulating fluid (the opposite of the directional arrows of FIGS. 3 and 3A) out of the vent panel 12 by way of the port 24 thereof. Thus, the circulating fluid is initially drawn from the adjacent areas by way of the diffusing layer 16 of the vent panel and any venting pores 22 in the edge band 20 of the vent panel 12, and then passes through the circulation layer 18 of the vent panel 12 and escapes from the vent panel 12 by way of the port 24. Here, it might be presumed that such circulating fluid as drawn out by the negative pressure is of a warmer and/or wetter nature than the environment outside the garment 10, and thus also provides a degree of comfort to the individual wearing same.

Depending on circumstances including use, function, manufacturability, and preference, among other things, it may be that either positive pressure or negative pressure is more suitable and/or desirable. Thus, if cooling is of primary importance, it may be that positive pressure is employed with the garment 10. Similarly, if humidity reduction is of primary importance, it may be that negative pressure is employed. Notably, circumstances may require a balancing of interests, wherein compromise is necessary. Thus, it may be that humidity reduction is desirable, but that the vent panels 12 are interior to a garment 10 that is to be worn against skin. In such case, negative pressure is more suitable to reduce the humidity, but may not be practical in that skin contact with the vent panels 12 would interfere with fluid flow as would otherwise be induced by such negative pressure. If so, it may be necessary to employ positive pressure rather than the more suitable negative pressure.

Note here that in either the first manner or the second manner, the circulation layer 18 should be of sufficient depth (top to bottom in FIG. 3A) so as to not impede the circulating fluid, but not so deep as to be perceived as being bulky or otherwise conspicuous. Such depth may of course vary based on many circumstances, but empirically it is believed that a depth of about 6-12 mm is sufficient in most cases.

With both the venting pores 22 in the edge band 20 of the vent panel 12 and the diffusing layer 16 in the vent panel 12, two kinds of circulation may be imparted within the garment. In particular, the venting pores 22 impart lateral flow along the surface of the garment 10, which is believed to be more likely to reduce humidity, and direct flow away from the surface of the garment 10, which is believed to be more likely to provide cooling. As should now be appreciated, depending on the location of the vent panel 12 and the function required thereby and thereat, and/or depending on personal preference, the circulation imparted thereby may be appropriately adjusted. For example, if lateral flow is desired at the expense of direct flow, the vent panel 12 may be constructed to have relatively more venting pores 22 and to have a relatively less permeable diffusing layer 16. Likewise, if direct flow is desired at the expense of lateral flow, the vent panel 12 may be constructed to have relatively less venting pores 22 and to have a relatively more permeable diffusing layer 16.

Figure 4:
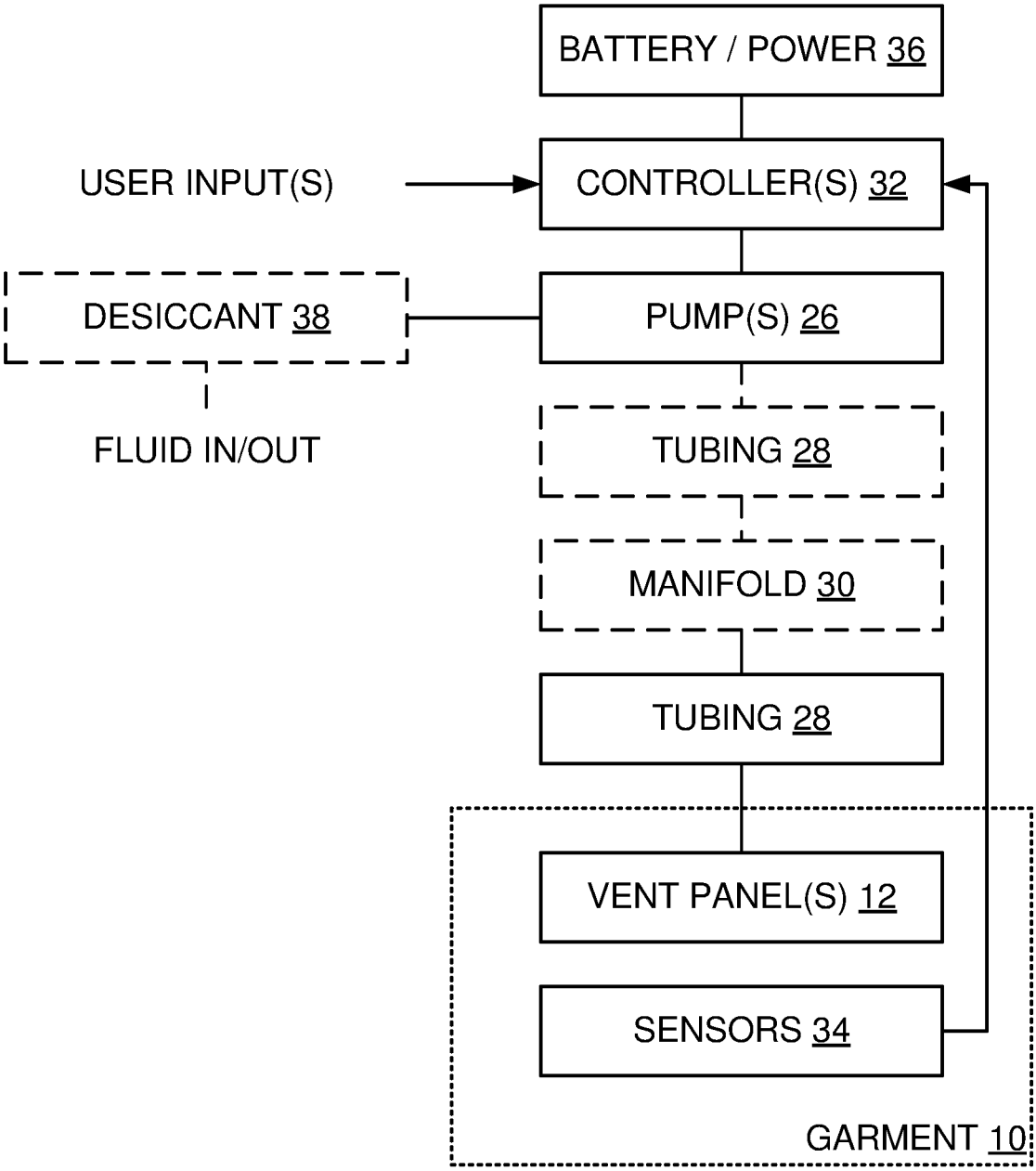
FIG. 4 is a block diagram of various components included with the vent panels of FIGS. 1-3 for operating same in accordance with various embodiments of the present innovation.

Turning now to FIG. 4, it is seen that the motive force that creates the positive or negative pressure is supplied by a pump 26 in various embodiments of the present innovation. As may be appreciated, the pump 26 may be any appropriate pump without departing from the spirit and scope of the present innovation, although it is to be appreciated that such pump should be small enough so as to be energy-efficient, light-weight, and inconspicuous, and yet large enough to be able to provide sufficient motive force. Selecting the appropriate pump 26 based on circumstances and design specifications is known or should be apparent to the relevant public, and therefore need not be set forth herein in any detail other than that which is provided.

In various embodiments of the present innovation, in order to satisfy the aforementioned goals, the pump 26 is an ultrasonic piezoelectric pump, such as for example one that is designed and/or marketed by TTP Ventus of Melbourn, Hertfordshire, United Kingdom (https://www.ttpventus.com/products), or by CurieJet of Taiwan (http://www.curiejet.com/en/). As may be appreciated, using such an ultrasonic piezoelectric pump 26 is advantageous in many respects. In particular, such pump 26 has quiet (ultrasonic) operation at about 20-25 kHz, is free of vibration, is lightweight, and is relatively flat and inconspicuous and thus comfortable to wear. Moreover, such pump 26 is customizable and controllable, and is operated and cared for with ease. Thus, such pump 26 can be integrated into the garment 10 without undue difficulty.

The general characteristics of the pump 26 may be expected to vary depending on circumstances and applications. That said, it likely is the case that the pump 26 should be removable or detachable, so that the garment 10 can be washed, for example. Also, the pump 26 should have a flow rate of about 0 to 5 liters/minute in the case of air, controllable by the individual wearing the garment 10, and an exit flow velocity between 1 and 10 meters/sec, also in the case of air. The body of the pump 26 should be about 1-10 grams in mass, operate at temperatures between 10 and 120 degrees F., and have an output/input pressure of about 1 to 10 psi.

As shown in FIG. 4, the pump 26 may be coupled to the vent panel 12 within the garment 10 by way of a conduit such as an appropriate length of flexible tubing 28 which, as should be understood is appropriately routed within the garment 10 and between such pump 26 and such vent panel 12. Thus, the pump 26 may in fact be located somewhat remotely from the vent panel 12, presuming that the tubing 28 is of sufficient character to accommodate such an arrangement. In particular, the tubing 28 should be large enough to provide a relatively unimpeded flow of the circulating fluid, and yet not so large as to become conspicuous or bulky. Also, the tubing 28 should be flexible to accommodate the flexibility of the garment 10, and yet should have sufficient structural integrity so as to not collapse or otherwise block the flow of the circulating fluid. Within such parameters, the tubing 28 may be any appropriate tubing without departing from the spirit and scope of the present innovation. For example, the tubing 28 may be constructed from an impermeable plastic or elastomeric material, with an inner diameter of about 2-5 mm. Selecting the appropriate tubing 28 based on circumstances and design specifications is known or should be apparent to the relevant public, and therefore need not be set forth herein in any detail other than that which is provided.

Presumptively, the pump 26 operates based on drawing circulating fluid in from the environment external to the garment 10, if creating the aforementioned positive pressure, or based on expelling circulating fluid out to the environment external to the garment 10, if creating the aforementioned negative pressure. In either case, the pump 26 is presumptively located external to the garment 10 or has appropriate access thereto, perhaps by way of other tubing, ducting, or the like. In any event, it may be necessary and/or appropriate that either the tubing 28 between the pump 26 and the vent panel 12 or other tubing, ducting, or the like is required to breach the garment 10 in order to gain access to the interior thereof. However, it has been empirically found that such breaching is oftentimes unnecessary, and can be avoided by careful routing. Moreover, such breaching should be avoided if possible, especially if such breaching would be aesthetically unpleasing, or would tend to allow for water leakage, among other things.

In general, locating the pump 26, the tubing 28, and any other tubing, ducting, or the like in relation to the garment 10 may be done in any appropriate manner without departing from the spirit and scope of the present innovation, bearing in mind that the pump 26 in particular should be located in an area where overheating is avoided. For example, it may be that the pump 26 is in a pocket of the garment 10 and the tubing 28 snakes therefrom through and into the garment 10 to the vent panel 12. Likewise, it may be that the pump 26 is located externally on a sleeve of the garment 10 and the tubing snakes down the exterior of sleeve, through an arm-hole, and then up the interior of the sleeve toward the vent panel 12. Selecting the locations and routings may be done based on circumstances and design specifications, and is known or should be apparent to the relevant public, and therefore need not be set forth herein in any detail other than that which is provided.

Although thus far disclosed in terms of a single pump 26 and a single tubing 28 communicating same with a single vent panel 12, it is to be appreciated that multiple pumps 26, tubings 28, and vent panels 12 may be configured in a garment 10 without departing from the spirit and scope of the present innovation, as is alluded to in FIG. 4. As but one example, it may be that the garment 10 has three vent panels 12, each with a tubing 26 interposed between same and a common manifold 30, and also another tubing interposed between the manifold 30 and a single pump 26. Also, it may be that each vent panel 12 has a corresponding pump 26 dedicated thereto and in communication therewith by way of a dedicated tubing 28 (not shown), in which case no manifold 30 is believed to be necessary. Likewise, it may be that a single pump 26 is arranged to be in communication with a plurality of serially arranged vent panels 12 by way of appropriate connective tubing 26 (also not shown), in which case no manifold 30 is believed to be necessary. Accordingly, and as should be understood, configuring pumps 26, tubings 28, manifolds 30, and vent panels 12 within a garment 10 may be done based on circumstances and design specifications, and is known or should be apparent to the relevant public, and therefore need not be set forth herein in any detail other than that which is provided.

Still referring to FIG. 4, it is seen that each pump 26 is controlled by an appropriately configured controller 32. As may be appreciated, each pump 26 may be controlled by its own dedicated controller 32, or a single controller 32 may control multiple pumps 26, all without departing from the spirit and scope of the present innovation. Notably, each controller 32 may be a relatively simple device that controls each pump 26 thereof based on one or a few parameters selected by the individual wearing the garment 10, such as flow rate, or may be a more sophisticated device that controls each pump 26 thereof based on multiple parameters, perhaps based on a programmable control unit or the like. Accordingly, and as should be understood, the type and level of control provided by the controller 32 may be decided based on circumstances and design specifications, and is known or should be apparent to the relevant public, and therefore need not be set forth herein in any detail other than that which is provided.

If indeed multiple pumps 26 are employed with multiple vent panels 12 in the garment 10, it may be that the pumps 26 and vent panels 12 are arranged to circulate fluid adjacent the garment 10 from one vent panel 12 to another vent panel 12. As such, one pump 26 may introduce positive pressure to the one vent panel 12, and another pump 26 may introduce negative pressure to the another vent panel 12, in an effort to drive the circulating fluid therebetween. In doing so, and as should now be appreciated, the circulating fluid as supplied by the positive pressure from the one pump 26 can be employed to cool the environment within the garment 10, can accumulate humidity from such environment within such garment 10, and can then be drawn out by the negative pressure from the another pump 26. Such an arrangement is believed to be advantageous inasmuch as fluid circulation within the garment 10 is improved, and is believed to be more efficient.

As shown in FIG. 4, the controller 32 may be operated based on user inputs from the individual wearing the garment 10, and based on feedback from one or more sensors 34 placed within the garment 10, including one or more temperature sensors 34 and one or more humidity sensors 34, among other things. Such user inputs may be any appropriate inputs without departing from the spirit and scope of the present innovation. For example, such user inputs may include on/off control, flow rate control, percentage of max flow rate control, outlet pressure control, inlet pressure control, humidity control, and/or the like, among other things.

Generally, based on such inputs and such sensors 34, it may be that as temperature and humidity increase, the controller 32 operates the pump 26 to increase the circulation of fluid through each connected vent panel 12, and likewise as temperature and humidity decrease, the controller 32 operates the pump 26 to decrease the circulation of fluid through each connected vent panel 12, all in an effort to reach a desired level as set by the inputs from the individual. As may be appreciated, the sensors 34 and operating the controller 32 based thereon may be performed in any appropriate manner without departing from the spirit and scope of the present innovation. Such operating is known or should be apparent to the relevant public, and therefore need not be set forth herein in any detail other than that which is provided.

As is also shown in FIG. 4, a battery or other power source 36 may be provided to operate the pump 26, the controller 32, and other related elements. As should be expected, the power source 36 should be of sufficient capacity to operate for at least a few hours if not 8-10 hours, but should not be so large as to be too heavy and/or bulky, especially inasmuch as the individual wearing the garment 10 will be carrying such power source 36 too. Although the power source 36 may be most any appropriate power source without departing from the spirit and scope of the present innovation, it is generally expected that the power source 36 may be in the nature of a rechargeable lithium-ion battery or the like that is lightweight and can be recharged in a few hours, perhaps by way of a USB connector or the like. Such a power source 36 is known or should be apparent to the relevant public, and therefore need not be set forth herein in any detail other than that which is provided.

Presumptively, the power source 36, the controller 32, and the pump 26 may be located relatively closely with respect to each other, especially if there is no countervailing reason. That said, it may nevertheless be the case that such items may be remotely located from each other, perhaps if necessary to balance out the weight of the items across the individual wearing the garment 10, or if necessary to effectuate connections therebetween. As before with regard to the pump 26 and the vent panel 12, care should be taken in connecting such items to among other things avoid unnecessarily breaching the garment 10, and also to avoid placing the connections within the garment 10 in a manner that may be perceived as uncomfortable by the individual wearing the garment 10.

In operation, the pump 26 in particular may on occasion be required to draw in relatively humid external air for delivery to the vent panel 12 within the garment 10. Especially if humidity within the garment 10 is a concern, and in various embodiments of the present innovation, a desiccant 38 may be provided at the intake to the pump 26, as is shown in FIG. 4. Accordingly, the desiccant 38 acts to dry the humid air prior to exposing same to the pump 26 itself and also to the vent panel 12 and the interior of the garment 10. Thus, humidity within the garment 10 is hopefully not exacerbated by the relatively humid external air, and also the pump 26 and the vent panel 12 are protected from any harmful effects that may occur based on exposure to such relatively humid external air. As should be understood, the desiccant 38 may be most any appropriate desiccant without departing from the spirit and scope of the present innovation, and such desiccant 38 is known or should be apparent to the relevant public, and therefore need not be set forth herein in any detail other than that which is provided.

FURTHER EMBODIMENTS

In the course of developing the garment 10 and constituent components thereof as has thus far been set forth above, it has been found that multiple further embodiments of the vent panel 12 in particular are available and advantageous. In particular, although the vent panel 12 as is shown in FIG. 3 et seq. and disclosed in connection therewith is highly useful, such vent panel 12 can be simplified and/or improved so as to among other things be constructed with greater ease and/or be made more efficient in operation, among other things, as will be set forth below.

Figure 5:
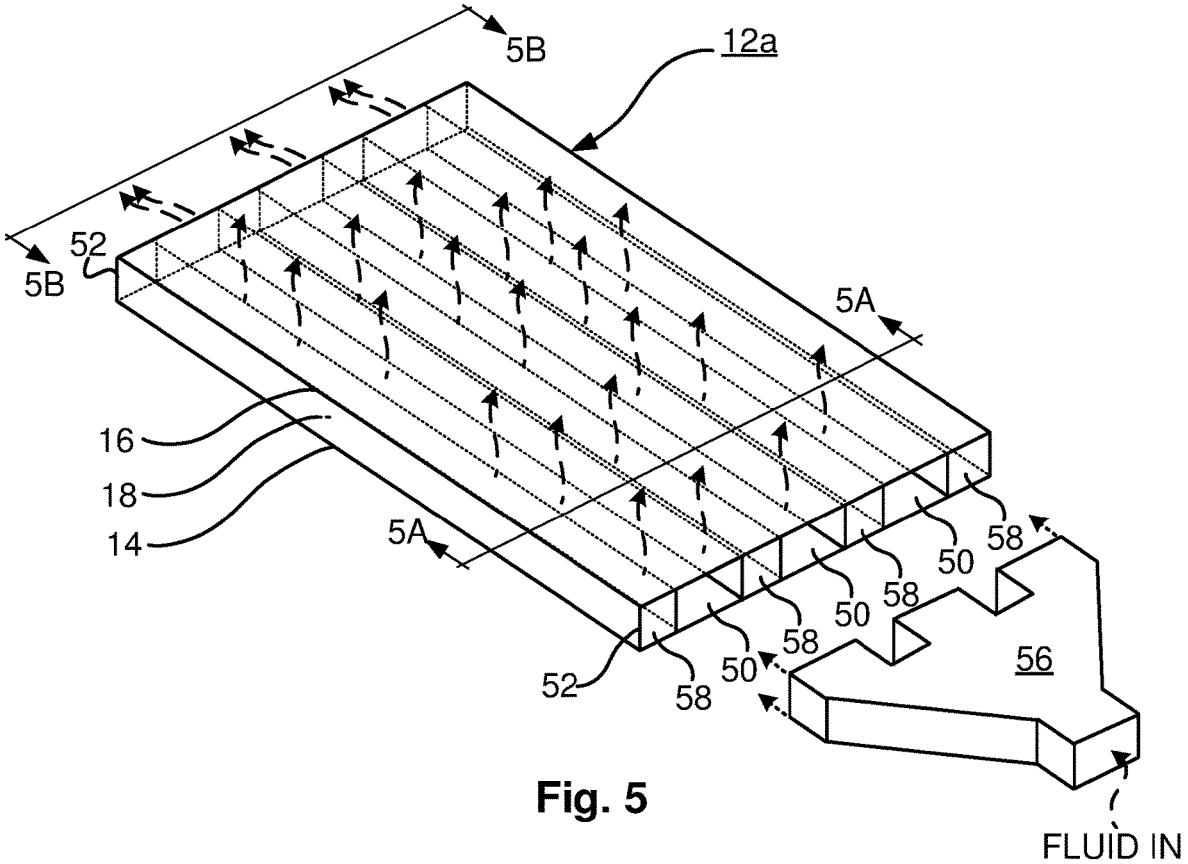
FIG. 5 is a perspective view of a vent panel akin to that of FIG. 1 and shows positive pressure flow therethrough in accordance with further embodiments of the present innovation.
Figure 5A:
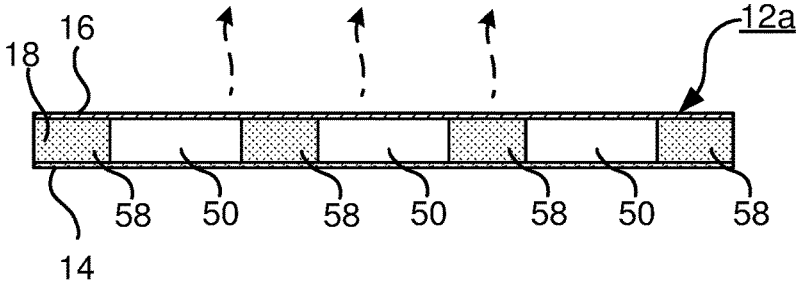
FIG. 5A is a cross-sectional view of the vent panel of FIG. 5 taken along the line 5A-5A thereof, and in particular shows the layers of the vent panel in accordance with further embodiments of the present innovation.

Specifically, and turning now to FIG. 5, it is seen that in further embodiments of the present innovation, a vent panel **12*a* may be employed in the garment 10 (omitted for clarity in FIG. 5 et seq.), where the vent panel 12*a* is mainly characterized as defining a plurality of generally linear and generally parallel channels 50 that extend between generally opposing peripheral edges 52 of the vent panel 12*a*. As seen in FIGS. 5 and 5A, three such channels 50 are shown, although it is to be appreciated that more or less channels 50** may also be employed without departing from the spirit and scope of the present innovation.

With such channels 50, and as should be appreciated by the relevant public, the vent panel **12*a* in orthogonal cross-section (FIG. 5A) is similar if not substantially identical regardless of where the orthogonal cross-section of FIG. 5A is taken, and as a result the vent panel 12*a* may be more easily manufactured as a continuous process, perhaps in the manner of a continuous extrusion or the like if deemed necessary and/or advisable. Of course, other methods of manufacture of the vent panel 12*a* and other geometries for the channels 50** may be employed without departing from the spirit and scope of the present innovation.

As before, the vent panel **12*a* of FIGS. 5 and 5A is generally of a multi-layer planar construction, with an impermeable attaching layer 14 at one face of the vent panel 12*a* which is intended to face toward the garment 10, a permeable diffusing layer 16 at the opposing face of the vent panel 12*a* which is intended to face away from the garment 10, and a circulation layer 18 interposed therebetween, where the channels 50 are defined within the circulation layer 18. Also as before, the vent panel 12*a* and the layers 14, 16, and 18 thereof are generally flexible, at least enough so that the vent panel 12***a* is permitted to flex along with the garment 10 as attached thereto. Thus, the vent panel 12 does not impede the movement of the garment 10, such as may be advantageous if the garment is to be worn during exercise. The attaching layer 14 again should be constructed from a plastic or elastomeric material or a lightweight woven fabric which is generally impermeable to the circulating fluid, be it air or otherwise, and correspondingly the diffusing layer 16 again should be constructed from a plastic or elastomeric material or a knit/woven fabric with stretch which is indeed generally permeable to such circulating fluid, again be it air or otherwise.

As interposed between the attaching layer 14 and the diffusing layer 16, the circulation layer 18 of the vent panel 12*a* may define the channels 50 therein in any appropriate manner without departing from the spirit and scope of the present innovation. Presumptively, each channel 50 defined in the vent panel 12*a* is open space demarcated by the absence of any material from the circulation layer 18 or otherwise, although it is to be appreciated that each channel 50 may alternately be defined from some sort of material within the circulation layer 18 without departing from the spirit and scope of the present innovation. In the latter case, it may be that the material defining each channel 50 is relatively diaphanous or gossamer so as to avoid impeding the flow of the circulating fluid therethrough, as much as is possible.

Here, the channels 50 and the circulation layer 18 defining same allow the circulating fluid, be it air or otherwise, to pass therethrough without undue constraint, both in a lateral flow from one peripheral edge 52 to the other peripheral edge 52, and in a direct flow through the circulation layer 18 of the vent panel 12*a* and past the diffusing layer 16 of the vent panel 12*a*. As should be appreciated by the relevant public, the amount of lateral flow and direct flow and the proportion therebetween may be controlled through judicious selection of the dimensions and number of the channels 50 and also by the judicious selection of the permeability of the circulation layer 18 and diffusing layer 16 of the vent panel 12*a*. Such judicious selection should be known or apparent to the relevant public, and therefore need not be set forth herein in any detail other than that which is provided.

Figure 5B:
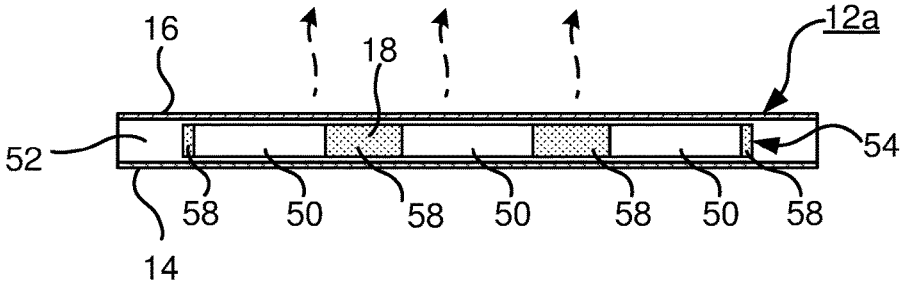
FIG. 5B is an end-on view of the vent panel of FIG. 5 taken along the line 5B-5B thereof, and in particular shows the opening at one peripheral edge of the vent panel in accordance with further embodiments of the present innovation.

As seen in FIG. 5 in particular, the vent panel 12*a* with the layers 14, 16, 18 need not necessarily be provided with the peripheral edge band 20 and venting pores 22 of the vent panel 12 of FIG. 3, if deemed necessary and/or advisable. Instead, the lateral flow along the surface of the garment 10 imparted by such vent pores 22 with regard to the vent panel 12 of FIG. 3 may instead be effectuated by an opening 54 (FIG. 5B) defined at one of the peripheral edges 52 of the vent panel 12*a*, where each channel 50 communicates externally from the vent panel 12*a* through the opening 54 in an effort to manage the circulation of fluid, be it air or otherwise, through such vent panel 12*a*. As may be appreciated, the opening 54 may merely be defined at the peripheral edge 52 thereof without any specific defining structure, or may be implemented with the aid of such a specific defining structure, such as a frame or insert of appropriate size and construction, without departing from the spirit and scope of the present innovation. As has been shown empirically, such opening 54 if judiciously dimensioned provides a sufficient amount of such lateral flow. As before, such judicious dimensioning should be known or apparent to the relevant public, and therefore need not be set forth herein in any detail other than that which is provided. Significantly, if the peripheral edge band 20 and venting pores 22 are omitted from the vent panel 12*a* of FIG. 5, a significant cost savings may be obtained both from simplified manufacturing and a reduction in materials required, as should be apparent to the relevant public.

As should be appreciated, and as is shown in FIG. 5 et seq., the circulating fluid is communicated between the pump(s) 26 (not shown in FIG. 5 et seq.) and the vent panel 12*a* by way of a panel manifold 56 interposed therebetween, where the panel manifold 56 is attached to the vent panel 12*a* at the peripheral edge 52 thereof opposite the peripheral edge 52 defining the opening 54. As seen in FIG. 5, the panel manifold 56 is exploded from the peripheral edge 52, although it is to be appreciated that in normal operation such panel manifold 56 may be fitted to the peripheral edge 52, perhaps by way of an interference fit or another fitting mechanism. As such, and as should be understood, the channels 50 of the vent panel 12*a* are interposed between the opening 54 and the panel manifold 56 such that at least a portion of the circulating fluid travels through the vent panel 12*a* between the opening 54 and the panel manifold 56. Notably, and as is shown, the panel manifold 56 is external from the vent panel 12*a* so as to simplify same. That said, the panel manifold 56 may alternately be integral with the vent panel 12*a* without departing from the spirit and scope of the present innovation. As should be understood, whether external or integral, the mechanism for coupling the panel manifold 56 and the vent panel 12*a* should be apparent to the relevant public based on the present disclosure, and accordingly the details thereof need not be set forth herein other than that which is provided.

Also notably, and as should be appreciated, the panel manifold 56 defines a plurality of channel orifices, each channel orifice for being in communication with a respective channel 50 of the vent panel 12*a*, as well as at least one pump orifice for being in communication with at least one respective pump 26 by way of appropriate tubing 28 or the like (not shown in FIG. 5 et seq.), so that the circulating fluid is communicated between the channels 50 of the vent panel 12*a* and the at least one respective pump 26. As should be understood, the panel manifold 56 may be of any appropriate design and construction without departing from the spirt and scope of the present innovation, as long as the circulating fluid is indeed communicated between the pump(s) 26 and the vent panel 12*a* in the manner intended. Such design and construction of such panel manifold 56 is known or should be apparent to the relevant public, and therefore need not be set forth herein in any detail other than that which is provided.

As before with regard to the vent panel 12 of FIG. 3, the vent panel 12*a* within the garment 10 allows the circulation of fluid, be it air or otherwise, in one of at least two manners. In the first manner, and as shown in FIG. 5 et seq., positive pressure is introduced externally to the vent panel 12*a* in an effort to drive the circulating fluid (the directional arrows of FIG. 5) into each channel 50 of the vent panel 12*a* by way of a pump 26 and the panel manifold 56. Thereafter, at least a first portion of the positively pressured circulating fluid travels through each channel 50 and across the vent panel 12*a* to exit from the opening 54 thereof as the aforementioned lateral flow, and at least a second portion of the positively pressured circulating fluid travels through each channel 50, into the circulation layer 18 of the vent panel 12*a* and exits the vent panel 12*a* from the diffusing layer 16 thereof as the aforementioned direct flow.

Likewise, in the second manner, which is in opposition to the manner shown in FIG. 5 et seq., negative pressure is introduced externally to the vent panel 12*a* in an effort to draw or pull the circulating fluid (the opposite of the directional arrows of FIG. 5) out from each channel 50 of the vent panel 12*a* by way of a pump 26 and the panel manifold 56. As should now be evident, at least a first portion of the negatively pressured circulating fluid travels from the opening 54 into each channel 50 and across the vent panel 12*a* to the panel manifold 56 as the aforementioned lateral flow, and at least a second portion of the negatively pressured circulating fluid travels from the diffusing layer 16 of the vent panel 12*a* by way of the circulation layer 18 of such vent panel 12*a* into each channel 50 and then to the panel manifold 56 as the aforementioned direct flow. As before, it might be presumed that such circulating fluid as drawn out by the negative pressure is of a warmer and/or wetter nature than the environment outside the garment 10, and thus also provides a degree of comfort to the individual wearing same.

Also as before, in either the first manner or the second manner, the circulation layer 18 of the vent panel 12*a* in particular and the overall vent panel 12*a* in general should be of sufficient depth (top to bottom in FIG. 3A) so as to not impede the circulating fluid, but not so deep as to be perceived as being bulky or otherwise conspicuous. Such depth may of course vary based on many circumstances, but empirically it is believed that a depth of about 6-20 mm is sufficient in most cases.

In the vent panel 12*a* of FIG. 5 et seq., and referring now to FIG. 5A in particular, it is seen that in various embodiments of the present innovation the circulation layer 18 of the vent panel 12*a* is formed as a plurality of pillars 58, where each pillar 58 extends generally between the attaching layer 14 and the diffusing layer 16 (vertically in the orthogonal cross-section of FIG. 5A), and is spaced a distance from at least one adjacent pillar 58 to define therebetween a channel 50 of the vent panel 12*a*. Thus, and as should now be apparent, the pillars 58 and channels 50 generally laterally alternate within the vent panel 12*a* of FIG. 5 et seq. Each pillar 58 of the circulation layer 18 of the vent panel 12*a* should be relatively incompressible at least in the vertical direction so as to resist vertical crushing and vertical deformation of the defined channels 50, and accordingly may be manufactured from an open- or closed-cell foam or a three-dimensional fabric, among other things. Of course, other materials may be employed for the pillars 58 without departing from the spirit and scope of the present innovation. Such other materials are known or should be apparent to the relevant public and therefore need not be set forth herein in any detail other than that which is provided.

Particularly where negative pressure is introduced externally to the vent panel 12*a* in an effort to draw or pull the circulating fluid (the opposite of the directional arrows of FIG. 5) out from each channel 50 of the vent panel 12*a*, it may be that the pillars 58 and the diffusing layer 16 are constructed from a wicking material that can draw not only circulating fluid that originates from within the garment 10 but moisture within and about such circulating fluid. Accordingly, and as should be evident, the vent panel 12*a* with such wicking material may be employed in an effort to reduce humidity and the like from within such garment 10. Such wicking material is known or should be apparent to the relevant public and therefore need not be set forth herein in any detail other than that which is provided.

Figure 6A:
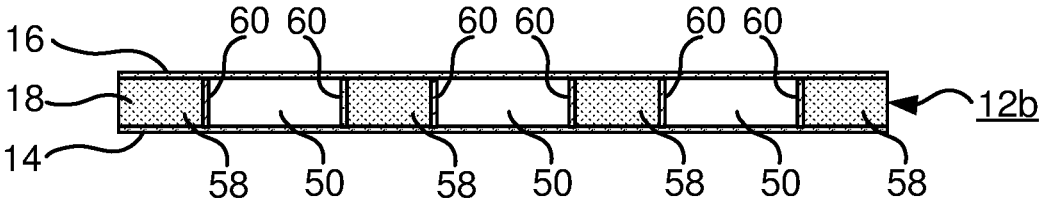
FIGS. 6A-6E are each cross-sectional views akin to that of FIG. 5A, and in particular each shows an alternate arrangement of the layers of the vent panel of FIG. 5 in accordance with further embodiments of the present innovation.
Figure 6B:
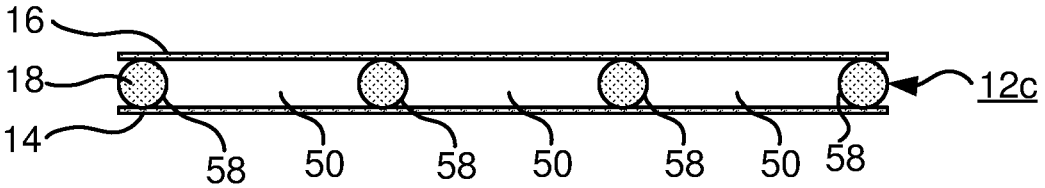
Figure 6C:
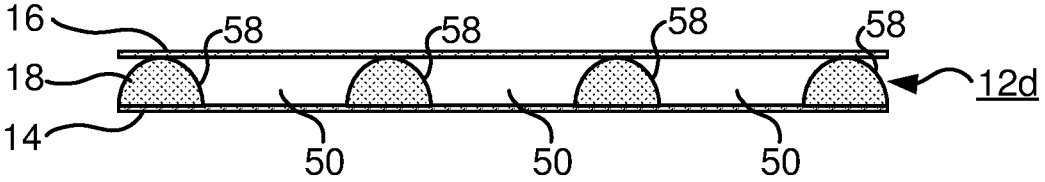
Figure 6D:
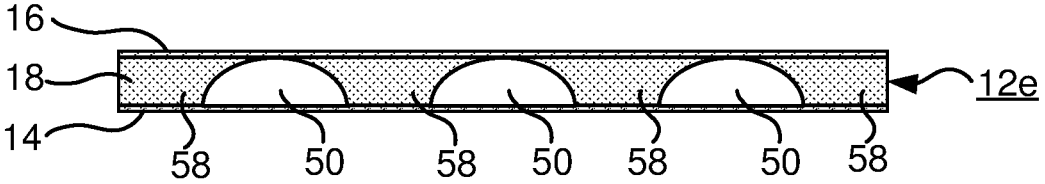
Figure 6E:
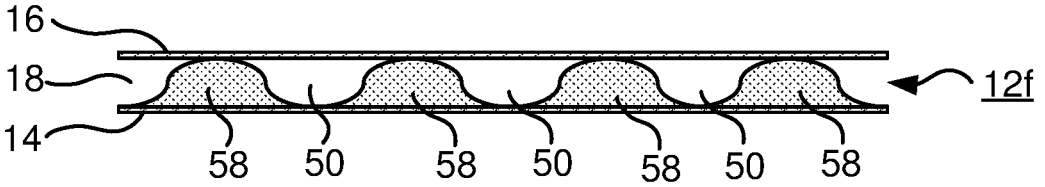

Alternately, and as seen in FIG. 6A, it may be that the pillars 58 are not constructed from such a wicking material but instead are lined with a wicking liner 60 that is in communication with the adjacently defined channel(s) 50 and the diffusing layer 16 of the vent panel 12*b*. As shown in the orthogonal cross-section of FIG. 6A, each pillar 58 on either lateral side thereof has such a wicking liner 60 interposed between the pillar 58 and the adjacent channel 50, where the interposed wicking liner 60 extends vertically between the attaching layer 14 and the diffusing layer 16, so as to communicate moisture from the diffusing layer 16 of the vent panel 12*b* to the adjacent channel 50. Presumptively, each wicking liner 60 would also extend longitudinally along the adjacent channel 50. As should be evident, the vent panel 12*b* with such wicking liners 60 can employ pillars 58 formed from a differing, perhaps non-wicking material, where the differing material of the pillars 58 may for example be better suited to resist vertical crushing, among other things. The wicking liners 60 may be formed from a wicking material that is known or should be apparent to the relevant public and therefore need not be set forth herein in any detail other than that which is provided, and likewise the wicking liners 60 may be formed into the vent panel 12*b* in a manner that is known or should be apparent to the relevant public and therefore need not be set forth herein in any detail other than that which is provided.

Although the pillars 58 and channels 50 defined thereby may have most any appropriate dimensions without departing from the spirit and scope of the present innovation, it has been empirically found that good results may be achieved if each pillar 58 in orthogonal cross-section is about 3-15 mm vertically (up and down in the orthogonal cross-section of FIG. 6A) and about 5-15 mm horizontally (side to side in the orthogonal cross-section of FIG. 6A), if each pillar 58 defines a channel 50 that in orthogonal cross-section is about 3-15 mm vertically and about 5-150 mm horizontally, if each of the attaching layer 14 and the diffusing layer 16 in orthogonal cross-section is about 0.5-3 mm vertically, if the number of channels 50 defined in the vent panel 12*a* is about 3-7 or perhaps even a single channel, and if each defined channel 50 is in length about 50-800 mm. Of course, other dimensions and arrangements may be employed without departing from the spirit and scope of the present innovation. Such dimensions are known or should be apparent to the relevant public and therefore need not be set forth herein in any detail other than that which is provided.

Turning now to FIGS. 6B-6E, it is seen that in alternate embodiments of the present innovation, the pillars 58 may in orthogonal cross-section have differing geometries. In particular, and turning now to FIG. 6B, it may be that the pillars 58 in orthogonal cross-section are generally circular or at least oval in shape. As may be appreciated, such circular or oval pillars 58 can be advantageous if for example the pillars 58 are previously extruded (not shown) or otherwise provided in such circular or oval form, and then the vent panel 12*c* is formed by sandwiching such circular or oval pillars 58 between the attaching layer 14 and the diffusing layer 16. Alternately, and turning now to FIGS. 6C-6E, it may be that the pillars 58 in orthogonal cross-section are upwardly arched (vent panel 12*d* of FIG. 6C) or downwardly arched (not shown), or that the pillars 58 in orthogonal cross-section define channels 50 in orthogonal cross-section that are upwardly arched (vent panel 12*e* of FIG. 6D) or downwardly arched (not shown), or that the pillars 58 and channels 60 in orthogonal cross-section and in combination exhibit a corrugation in the manner of a sinusoidal wave extending laterally (vent panel 12*f* of FIG. 6E). As may be appreciated, any of the arrangements of FIGS. 6B-6E may be advantageous, depending on circumstances, for example in the manufacture or use of the vent panels 12*c*, 12*d*, 12*e*, 12*f*, among other things.

Note here that the pillars 58 of the vent panels 12*c*, 12*d*, 12*e*, 12*f* of FIGS. 6B-6E likely are not lined with any wicking liner 60 such as that of the vent panel 12*b* of FIG. 6A, although such lining may nevertheless occur without departing from the spirit and scope of the present innovation. Note too, that the methods of manufacturing any of the vent panels 12*a*-12*f* are known or should be apparent to the relevant public, and therefore need not be set forth herein in any detail other than that which is provided.

Figure 7:
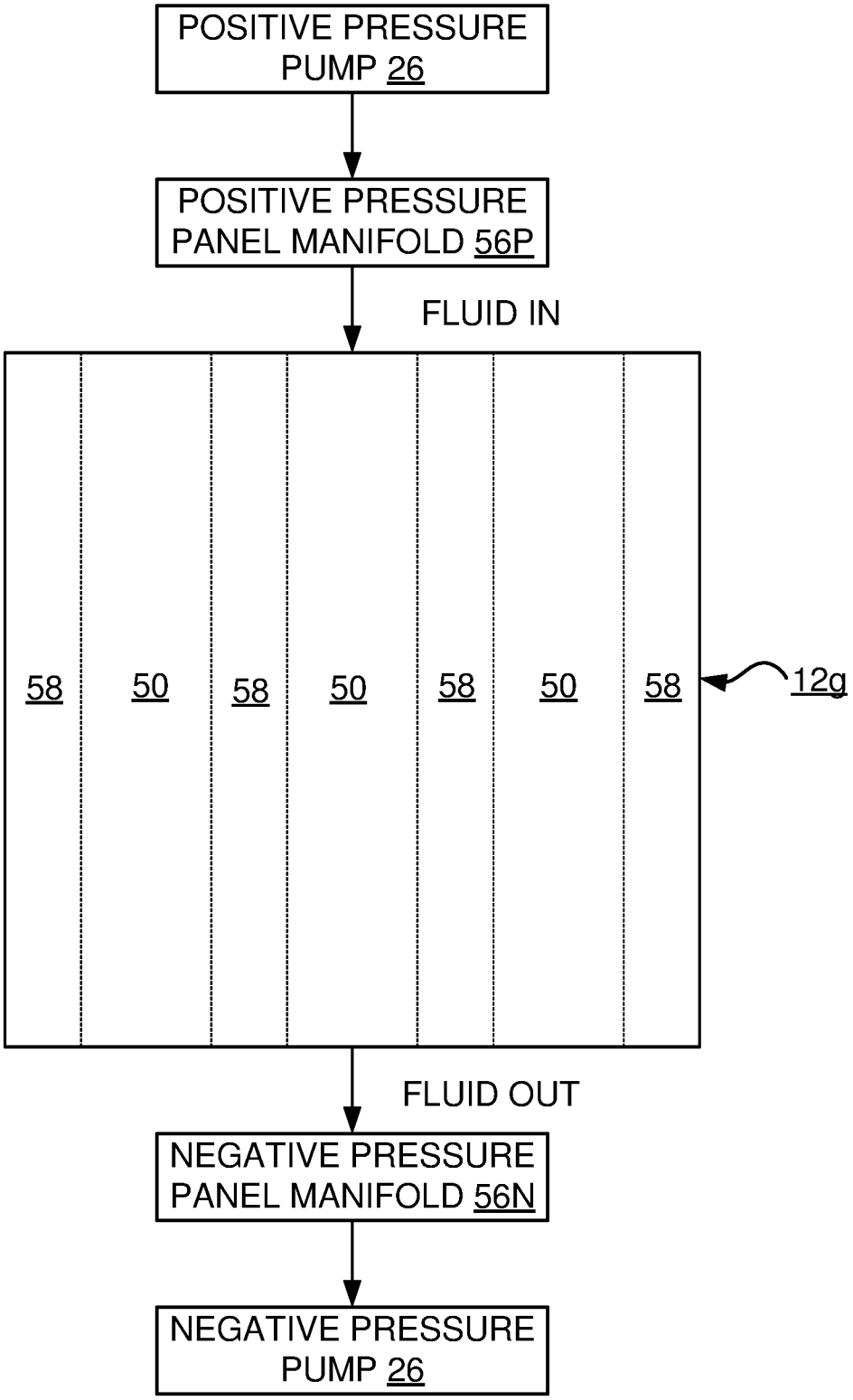
FIG. 7 is a block diagram of various components including the vent panel of any of FIGS. 5 and 6A-6E, and in particular shows the vent panel having both positive and negative pressure applied thereto at opposing ends thereof in accordance with further embodiments of the present innovation.

Turning now to FIG. 7, it is seen that in one embodiment of the present innovation a vent panel 12*g* is provided, where the opening 54 of the vent panel 12*a* is replaced with another panel manifold 56, such that a first one of the panel manifolds 56 is a positive pressure panel manifold 56P that introduces a positive pressure to the vent panel 12*g* from a first (positive pressure) pump 26, and such that a second one of the panel manifolds 56 is a negative pressure panel manifold 56N that introduces a negative pressure to the vent panel 12*g* from a second (negative pressure) pump 26. Accordingly, the first and second pumps in combination both drive the circulating fluid into the vent panel 12*g* and draw the circulating fluid out from the same vent panel 12*g*. Thus, and as should be appreciated, the flow of the circulating fluid within the vent panel is increased, and the cooling effect provided by same to the garment 10 is likewise increased.

As should be evident, it may be that by applying positive pressure at one side of the vent panel 12*g* of FIG. 7 and negative pressure at the other side of such vent panel, substantially all of the circulating fluid may travel in the channels 50 therebetween without much opportunity for such circulating fluid to travel through the circulation layer 18 of the vent panel 12*g* and exit or enter the vent panel 12*g* from the diffusing layer 16 thereof. Nevertheless, if such vent panel 12*g* is designed to wick moisture from within the garment 10 and into communication with the channels 50 thereof, such communicated moisture may be more effectively removed from the vent panel 12*g* in such an arrangement. Of course, other arrangements may be employed in connection with the vent panel 12*g* of FIG. 7 without departing from the spirit and scope of the present innovation.

In any of the embodiments set forth herein, it is to be appreciated that although reference may be made to an element as a single element or as a set number of elements, such element may alternately appear as other numbers of elements without departing from the spirit and scope of the present innovation. For example, with regard to the panel manifold 56 such as has been set forth above in connection with FIG. 5 et seq., only a single panel manifold 56 is shown in FIG. 5 in particular, although other numbers of panel manifolds 56 may alternately be employed. Thus, it may be that in a particular instance, two manifolds 56, each having two channel orifices, may be employed in connection with a vent panel 12*a* or the like having four channels 50, with appropriate modification, to name one of many possible variations.

More generally, then, all manner of alternate arrangements of panel manifolds 56, channel orifices and pump orifices thereof, pumps 26, openings 54, channels 50, pillars, 58, etc. may be employed without departing from the spirit and scope of the present innovation. As but a few examples: a single panel manifold 56 may have two pump orifices, each pump orifice in communication with a separate one of a plurality of pumps; multiple panel manifolds 56 may each have a channel orifice in communication with a common channel 50; a plurality of openings 54 may be provided, each opening 54 in communication with a single channel 50 or in communication with more than one channel 50; etc. As should be appreciated, rationales for such alternate arrangements and details for effectuating same are known or should be apparent to the relevant public and therefore need not be set forth herein with any detail beyond that which is already provided.

CONCLUSION

Any programming and protocols believed necessary to effectuate the processes performed by the controller 32 in particular for the pump-conditioned garment 10 of the present innovation should be relatively straight-forward and should be apparent to the relevant programming and protocol-setting public. Accordingly, such programming and protocols are not attached hereto. Any particular programming and protocols, then, may be employed to effectuate the various embodiments of the present innovation without departing from the spirit and scope thereof.

In the present innovation, a pump-conditioned garment 10 and apparatus therefor are set forth in which a pump 26 is employed to actively and adaptably vent the garment 10. The apparatus pumps or otherwise circulates a fluid within the garment 10 in an effort to establish an environment within the garment 10 that is more comfortable to an individual wearing the garment 10. The apparatus may include an air pump 26 for circulating venting air within the garment 10 in response to sensed changes to the environment within the garment 10 and also changes to the external environment.

It should be appreciated that changes could be made to the embodiments described above without departing from the innovative concepts thereof. For example, the garment 10 though primarily set forth as a wearable garment can also be any covering or protective device meant for an individual where the individual may wish to control the environment interior thereto. Also, although the pump 26 is set forth primarily in terms of operation with air as the circulating fluid, the pump 26 may instead operate with any other fluid, be it a gas or a liquid, as may be deemed necessary and/or desirable. Finally, although suggestions for placement of individual elements may be provided herein, such elements may be placed in any appropriate manner with respect to each other and with respect to the garment 10, again as may be deemed necessary and/or appropriate. For example, in this regard, although the channels 50 defined by the pillars 58 have been described as generally linear and generally parallel, such channels 50 may instead curve, for example, and even diverge from one another, as may be deemed necessary and/or desirable. It should be understood, therefore, that this innovation is not limited to the particular embodiments disclosed, but it is intended to cover modifications within the spirit and scope of the present innovation as defined by the appended claims.

The invention claimed is:

1. A pump-conditioned garment for covering at least a portion of an individual, the garment comprising:

at least one fluid-circulating vent panel for circulating a gaseous fluid comprising ambient air adjacent the garment and external from the vent panel in an effort to condition the individual; and a pump for providing a motive force to circulate the circulating fluid through each vent panel, the garment comprising a covering layer, and each vent panel having a multi-layer planar construction including:

an attaching layer at one face of the vent panel and facing toward the covering layer, the attaching layer being generally impermeable to the circulating fluid, the vent panel being attached to the covering layer at the attaching layer;

a diffusing layer at an opposing face of the vent panel and facing away from the covering layer, the diffusing layer being generally permeable to the circulating fluid to allow same to circulate therethrough and external from the vent panel in an effort to condition the individual; and a circulation layer interposed between the attaching layer and the diffusing layer, the circulation layer defining a plurality of channels therethrough, each channel of the circulation layer being in communication with the pump by way of a panel manifold at one peripheral edge of the vent panel and also being in communication with a respective opening defined at another peripheral edge of the vent panel, each channel of the circulation layer allowing the circulating fluid to pass therethrough between the panel manifold and the respective opening and also between the panel manifold and the diffusing layer, each opening imparting a lateral flow of the circulating fluid along the covering layer of the garment and external from the vent panel, the diffusing layer imparting a direct flow of the circulating fluid away from the covering layer of the garment and external from the vent panel, the pump comprising an ultrasonic piezoelectric pump with a mass of about 1-10 grams.

2. The garment of claim 1 wherein the channels defined in the vent panel are generally linear and generally parallel and extend between generally opposing peripheral edges of the vent panel.

3. The garment of claim 1 wherein each channel defined in the vent panel is open space demarcated by the absence of any material from the circulation layer.

4. The garment of claim 1 wherein each channel defined in the vent panel is defined from a diaphanous material within the circulation layer which avoids impeding the circulating fluid therethrough.

5. The garment of claim 1 further comprising the panel manifold fitted to the one peripheral edge and external from the vent panel, the panel manifold defining a plurality of channel orifices, each channel orifice in communication with a respective channel, and a pump orifice in communication with the pump, whereby the circulating fluid is communicated by the panel manifold between the channels and the pump.

6. The garment of claim 1 wherein the circulation layer of the vent panel is formed as a plurality of pillars, each pillar extending generally between the attaching layer and the diffusing layer, each pillar being spaced a distance from at least one adjacent pillar to define therebetween one of the plurality of channels.

7. The garment of claim 1 wherein the circulation layer of the vent panel is formed as a plurality of pillars, each pillar being spaced a distance from at least one adjacent pillar to define therebetween one of the plurality of channels, each pillar being formed from a material that resists crushing so as to avoid corresponding deformation of the defined channels.

8. The garment of claim 1 wherein the circulation layer of the vent panel is formed as a plurality of pillars, each pillar being spaced a distance from at least one adjacent pillar to define therebetween one of the plurality of channels, wherein negative pressure is introduced externally to the vent panel in an effort to draw the circulating fluid out from each channel, and wherein each pillar and the diffusing layer are constructed from a wicking material that can draw moisture that originates from within the garment, whereby such wicking material is employed in an effort to reduce humidity from within the garment.

9. The garment of claim 1 wherein the circulation layer of the vent panel is formed as a plurality of pillars, each pillar being spaced a distance from at least one adjacent pillar to define therebetween one of the plurality of channels, wherein negative pressure is introduced externally to the vent panel in an effort to draw the circulating fluid out from each channel, wherein the diffusing layer is constructed from a wicking material that can draw moisture that originates from within the garment, and wherein each pillar is lined with a wicking material that can draw such moisture from the diffusing layer and that is in communication with an adjacently defined channel, whereby the wicking material of the diffusing layer and the wicking material lining each pillar are employed in combination in an effort to reduce humidity from within such garment.

10. The garment of claim 1 wherein the circulation layer of the vent panel is formed as a plurality of pillars, each pillar being spaced a distance from at least one adjacent pillar to define therebetween one of the plurality of channels, each pillar in orthogonal cross-section being generally circular or oval in shape.

11. The garment of claim 1 wherein the circulation layer of the vent panel is formed as a plurality of pillars, each pillar being spaced a distance from at least one adjacent pillar to define therebetween one of the plurality of channels, each pillar in orthogonal cross-section being generally arched toward either the diffusing layer or the attaching layer of the vent panel.

12. The garment of claim 1 wherein the circulation layer of the vent panel is formed as a plurality of pillars, each pillar being spaced a distance from at least one adjacent pillar to define therebetween one of the plurality of channels, each defined channel in orthogonal cross-section being generally arched toward either the diffusing layer or the attaching layer of the vent panel.

13. The garment of claim 1 wherein the circulation layer of the vent panel is formed as a plurality of pillars, each pillar being spaced a distance from at least one adjacent pillar to define therebetween one of the plurality of channels, the pillars and defined channels in combination and in orthogonal cross-section exhibiting a laterally extending corrugation.

14. The garment of claim 1 comprising a plurality of the vent panels, each vent panel for circulating a fluid adjacent the garment in an effort to cool and/or dehumidify the individual.

15. The garment of claim 1 having an interior surface and defining an interior space within the interior surface, each vent panel being positioned on the interior face of the garment to condition the interior space defined thereby.

16. The garment of claim 1 wherein the pump performs one of: introducing to the vent panel negative pressure to draw the circulating fluid therefrom, thereby removing moist warm air adjacent the vent panel, and introducing to the vent panel positive pressure to drive the circulating fluid thereinto, thereby adding cool dry air adjacent the vent panel.

17. The garment of claim 1 wherein the ultrasonic piezoelectric pump operates at about 20-25 kHz.

18. An apparatus for pump-conditioning a garment, the garment for covering at least a portion of an individual, the apparatus comprising:

at least one fluid-circulating vent panel for circulating a gaseous fluid comprising ambient air adjacent the garment and external from the vent panel in an effort to condition the individual; and a pump for providing a motive force to circulate the circulating fluid through each vent panel, the garment comprising a covering layer, and each vent panel having a multi-layer planar construction including:

an attaching layer at one face of the vent panel for facing toward the covering layer, the attaching layer being generally impermeable to the circulating fluid, the vent panel for being attached to the covering layer at the attaching layer;

a diffusing layer at an opposing face of the vent panel for facing away from the covering layer, the diffusing layer being generally permeable to the circulating fluid to allow same to circulate therethrough and external from the vent panel in an effort to condition the individual; and a circulation layer interposed between the attaching layer and the diffusing layer, the circulation layer defining a plurality of channels therethrough, each channel of the circulation layer for being in communication with the pump by way of a panel manifold at one peripheral edge of the vent panel and also being in communication with a respective opening defined at another peripheral edge of the vent panel, each channel of the circulation layer for allowing the circulating fluid to pass therethrough between the panel manifold and the respective opening and also between the panel manifold and the diffusing layer, each opening for imparting a lateral flow of the circulating fluid along the covering layer of the garment and external from the vent panel, the diffusing layer for imparting a direct flow of the circulating fluid away from the covering layer of the garment and external from the vent panel, the pump comprising an ultrasonic piezoelectric pump with a mass of about 1-10 grams.

19. The apparatus of claim 18 wherein the channels defined in the vent panel are generally linear and generally parallel and extend between generally opposing peripheral edges of the vent panel.

20. The apparatus of claim 18 wherein the ultrasonic piezoelectric pump operates at about 20-25 kHz.

* * * * *